US012727628B2

(12) United States Patent
Muhammad

(10) Patent No.: US 12,727,628 B2
(45) **Date of Patent: *Sep. 8, 2026**

(54) PANT CLOTHING FOR UNIPED

(71) Applicant: Dignité LLC, Adelanto, CA (US)

(72) Inventor: Tonisha Muhammad, Adelanto, CA (US)

(73) Assignee: Dignité LLC, Adelanto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/917,810

(22) Filed: Oct. 16, 2024

(65) Prior Publication Data

US 2025/0031777 A1 Jan. 30, 2025

Related U.S. Application Data

(63) Continuation of application No. 17/688,842, filed on Mar. 7, 2022, now Pat. No. 12,144,383.

(60) Provisional application No. 63/157,461, filed on Mar. 5, 2021.

(51) Int. Cl.
*A41D 1/06* (2006.01)

(52) U.S. Cl.
CPC ..... *A41D 1/06* (2013.01)

(58) Field of Classification Search
CPC .. A41D 1/06; A41D 2300/30; A41D 13/1254; A41D 13/1263; A41D 15/002; A41D 15/04; A41D 13/02; A41B 13/04; A41B 13/005
See application file for complete search history.

(56) References Cited

U.S. PATENT DOCUMENTS

| | | | | |
|---|---|---|---|---|
| 2,738,512 | A * | 3/1956 | Winer | A41B 13/005 2/72 |
| 3,214,771 | A | 11/1965 | Treiber | |
| 5,592,693 | A | 1/1997 | Jenson | |
| 5,717,999 | A | 2/1998 | Lurry | |
| 8,827,941 | B2 | 9/2014 | Davis | |
| 9,713,354 | B2 | 7/2017 | Bolen | |
| 9,867,965 | B1 | 1/2018 | Kantor | |
| 2006/0085895 | A1* | 4/2006 | Wojeski | A41B 11/14 2/409 |
| 2008/0092273 | A1* | 4/2008 | Marshall | A41D 1/08 2/227 |
| 2010/0017933 | A1 | 1/2010 | Taylor-Barry | |
| 2011/0078839 | A1 | 4/2011 | Leonard | |
| 2017/0027254 | A1* | 2/2017 | Myerscough | A41D 15/002 |

(Continued)

FOREIGN PATENT DOCUMENTS

| | | | | |
|---|---|---|---|---|
| CN | 202525115 U | * | 11/2012 | |
| GB | 2446364 A | * | 8/2008 | A41D 19/0089 |

OTHER PUBLICATIONS

Han et al. Adjustable Lower Limb After amputation Dressing Fixing Belt, Apr. 9, 2014, CN 203524852 U (Year: 2014).

*Primary Examiner* — Aiying Zhao
(74) *Attorney, Agent, or Firm* — Squire Patton Boggs (US) LLP

(57) ABSTRACT

A pant clothing item for uniped or bilateral amputee persons includes a modified distal opening of at least one pant leg with a cover portion, where upon fastening the cover portion to the modified distal opening, the cover portion encloses the distal opening of the pant leg and protects the residual limb from exposure.

17 Claims, 6 Drawing Sheets

(56) References Cited

U.S. PATENT DOCUMENTS

2020/0329785 A1* 10/2020 Weide ..... A41D 1/06
2021/0386128 A1* 12/2021 Dickson ..... A41F 9/025

* cited by examiner

PANT CLOTHING FOR UNIPED

CROSS-REFERENCE TO RELATED APPLICATIONS

The present application is a continuation application of U.S. application Ser. No. 17/688,842 filed on Mar. 7, 2022, which claims the benefit of U.S. provisional application No. 63/157,461, filed Mar. 5, 2021, the entire contents of both of which are hereby incorporated by reference.

FIELD OF THE INVENTION

The field of the invention is clothing designed to accommodate uniped and bilateral amputee persons.

BACKGROUND

The following description includes information that may be useful in understanding the present invention. It is not an admission that any of the information provided herein is prior art or relevant to the presently claimed invention, or that any publication specifically or implicitly referenced is prior art.

Clothing options for uniped persons are typically limited to clothing—e.g., pants intended for biped persons for which the unused pant leg is folded around the base of the residual limb. The use of biped pants on unipeds results in either a noticeably unoccupied pant leg or folding of the excess fabric of the unused pant leg. Such modified uses of biped clothing do not provide the uniped person with a feeling of comfort or accommodation.

Furthermore, if the unused pant leg of biped pants is cut to remove some of the excess fabric, the residual limb is often exposed upon any shifting of the clothing, bringing emotional discomfort to the uniped person as well as exposing the skin of the residual limb which is often sensitive, especially if healing.

Thus, there is still a need for pants that accommodate the asymmetry of uniped persons and can provide dignity and comfort for both uniped persons as well as bilateral amputees.

SUMMARY OF THE INVENTION

The inventive subject matter provides an article of pant clothing (i.e. a pair of pants) for uniped or double amputee persons wherein one or both of the two pant legs includes a means for attaching the distal opening of the pant leg to a cover portion or limb protector which upon full attachment of the cover portion to the distal opening of the pant leg, covers and encloses the opening at the distal end of the pant leg.

In particular embodiments, for uniped persons, the pant clothing includes one pant leg (e.g. a first pant leg) having a length that is less than the length of the second pant leg, where the distal opening (e.g. of the first pant leg) includes a means for attaching the distal opening of the pant leg to a cover portion or limb protector which upon full attachment of the cover portion to the distal opening of the first pant leg, covers and encloses the opening.

In exemplary embodiments, the means for attaching the end of the shorter length pant leg (or in the case of a double amputee, the end of one of the pant legs) to the cover (limb protector) includes cognate folded fabric, zipper, cinch cords, buttons, hook and loop fastener (e.g., Velcro®), snaps, or a combination thereof.

In additional embodiments, the cover portion may be capable of being completely removed from the pant leg. Alternatively, a small area of the cover portion may be attached to the pant leg upon unfastening (e.g. unfolding, unzipping, uncinching, unbuttoning, un-Velcroing, and/or unsnapping) the means for attaching the cover portion to the pant leg to the cover portion, thereby allowing for access to the person's residual limb without having to completely detach the cover portion from the pant clothing.

In further embodiments, the contemplated article of pant clothing for a person lacking both feet and/or legs (e.g., a bilateral or double amputee), wherein the pant clothing has two pant legs having a cover portion as disclosed herein, that is attached to each of the distal ends of the pant legs. The two pant legs may be of the same length or of different lengths.

Various objects, features, aspects and advantages of the inventive subject matter will become more apparent from the following detailed description of preferred embodiments, along with the accompanying drawing figure in which like numerals represent like components.

DETAILED DESCRIPTION

The contemplated pant clothing item includes a pant clothing item to be worn by a uniped or double amputee person that includes at least one cover portion for covering and enclosing the residual limb(s), also referred colloquially as a "stump."

The pant clothing item as disclosed herein includes a trunk portion as found in any conventional pair of pants for fitting around and clothing the waist and pelvic area of the person wearing the pants. With reference to the disclosed pant clothing item and the terms used herein, the term "distal" or "distally" refers to a direction away from the trunk of the pants or the waist area of person, in the direction towards the person's foot or end of residual limb (leg). Similarly, the term "proximal" describes a direction towards the trunk, waist, pelvic area of the person and/or pant clothing item.

Figure 1A:
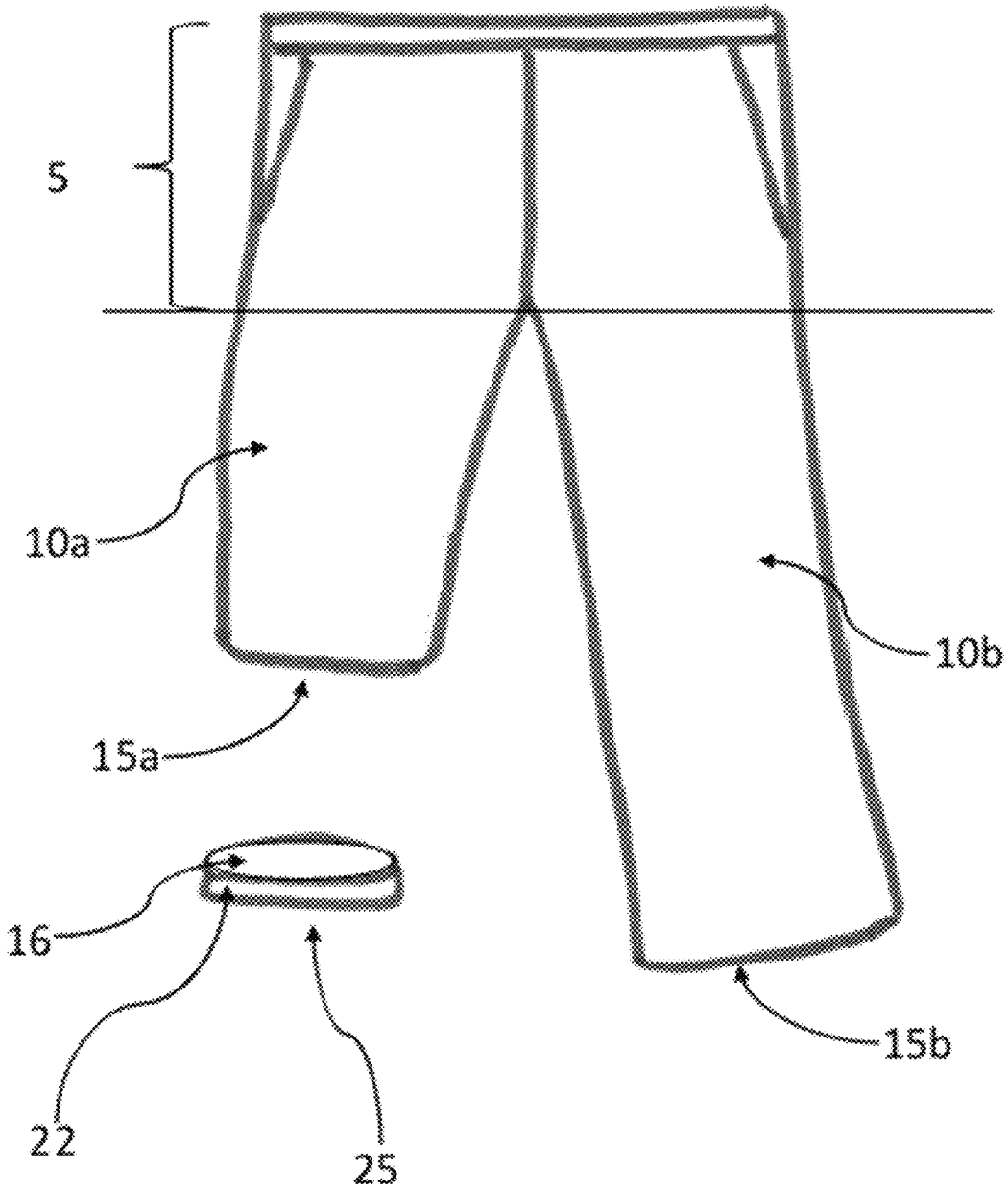
FIG. 1A is an exemplary illustration of the contemplated pant clothing having pant legs of different lengths with the shorter length pant leg 10*a* having a modified distal opening 15*a* as shown, that can be coupled to a cover portion 25, according to embodiments of the present disclosure.

With reference to FIG. 1A, the pant clothing item includes a trunk or upper portion 5 for clothing the hips, buttocks, and groin area above the legs. The pant clothing item also includes two pant legs which may be of the same or different lengths. The two pant legs may be referred to as a first pant leg and a second pant leg irrespective of the length of either of the two pant legs. As shown in one embodiment in FIG. 1A, pant leg 10*a* has a shorter length than pant leg 10*b*. In other embodiments, the contemplated clothing item includes both pant legs having the same or different lengths in which both pant legs are modified at the distal opening 15*a* to accommodate a double amputee. As such, the clothing item having two pant legs 10*a*, 10*b* may have one modified distal opening 15*a* to accommodate the residual limb of a uniped person with the distal opening 15*b* unmodified to allow the foot to come through the pant leg 10*b*. In other embodiments, the clothing item may have two modified distal openings 15*a* to accommodate both residual limbs of a bilateral amputee person. For a pant clothing item having two modified distal openings, the pant clothing item includes two portion covers 25, one for each modified distal opening 15*a*. All various embodiments as disclosed herein for the modification of the distal opening 15*a* and the corresponding cover portion 25 may be applied in all possible combinations and options as disclosed herein to a pant clothing item having two modified distal openings 15*a*.

With continued reference to FIG. 1A, a distal opening is found in both of the two pant legs (e.g., the first pant leg and the second pant leg) at the end of each pant leg in the opposite direction of the upper portion 5. The contemplated advantage of the disclosed clothing item includes a pant leg 10*a* modified to accommodate an amputated leg in which the pant leg 10*a* has a modified distal opening 15*a* with a corresponding cover portion 25. Notably, with reference to both FIGS. 1A-1B, the cover portion 25 is flat and has an inner cloth section 16 and an outer cloth section 22 (where sections 16, 22 may be opposite sides of a section of cloth) that attaches to the pant leg 10*a* and when the cover portion 25 is completely attached to the pant leg 10*a*, the distal opening 15*a* is covered—i.e., the distal opening is closed.

Figure 1B:
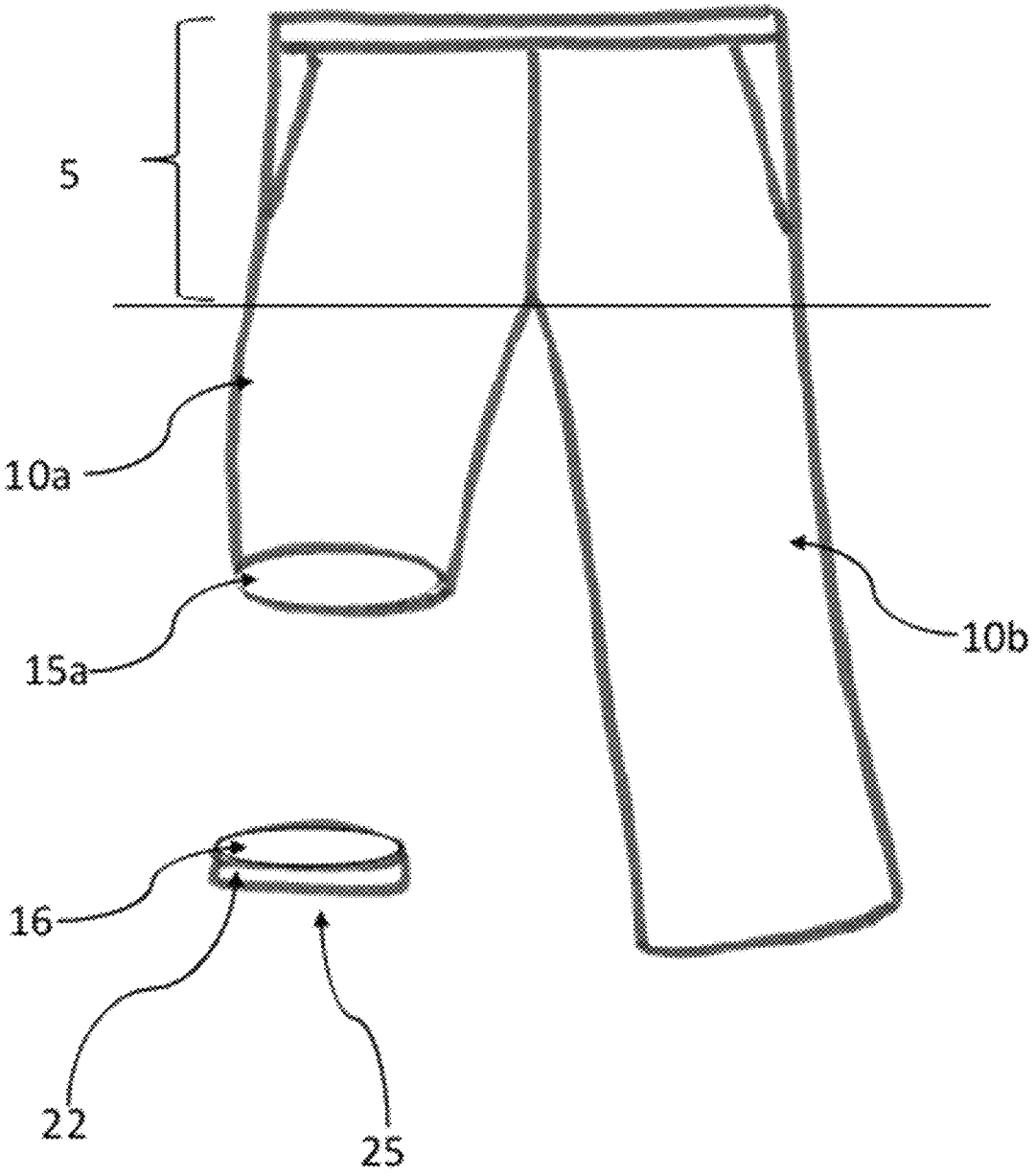
FIG. 1B is an exemplary illustration of the contemplated pant clothing having pant legs of different lengths with the shorter length pant leg 10*a* having a modified distal opening 15*a* (not shown) that can be coupled to a cover portion 25, according to embodiments of the present disclosure.
Figure 1C:
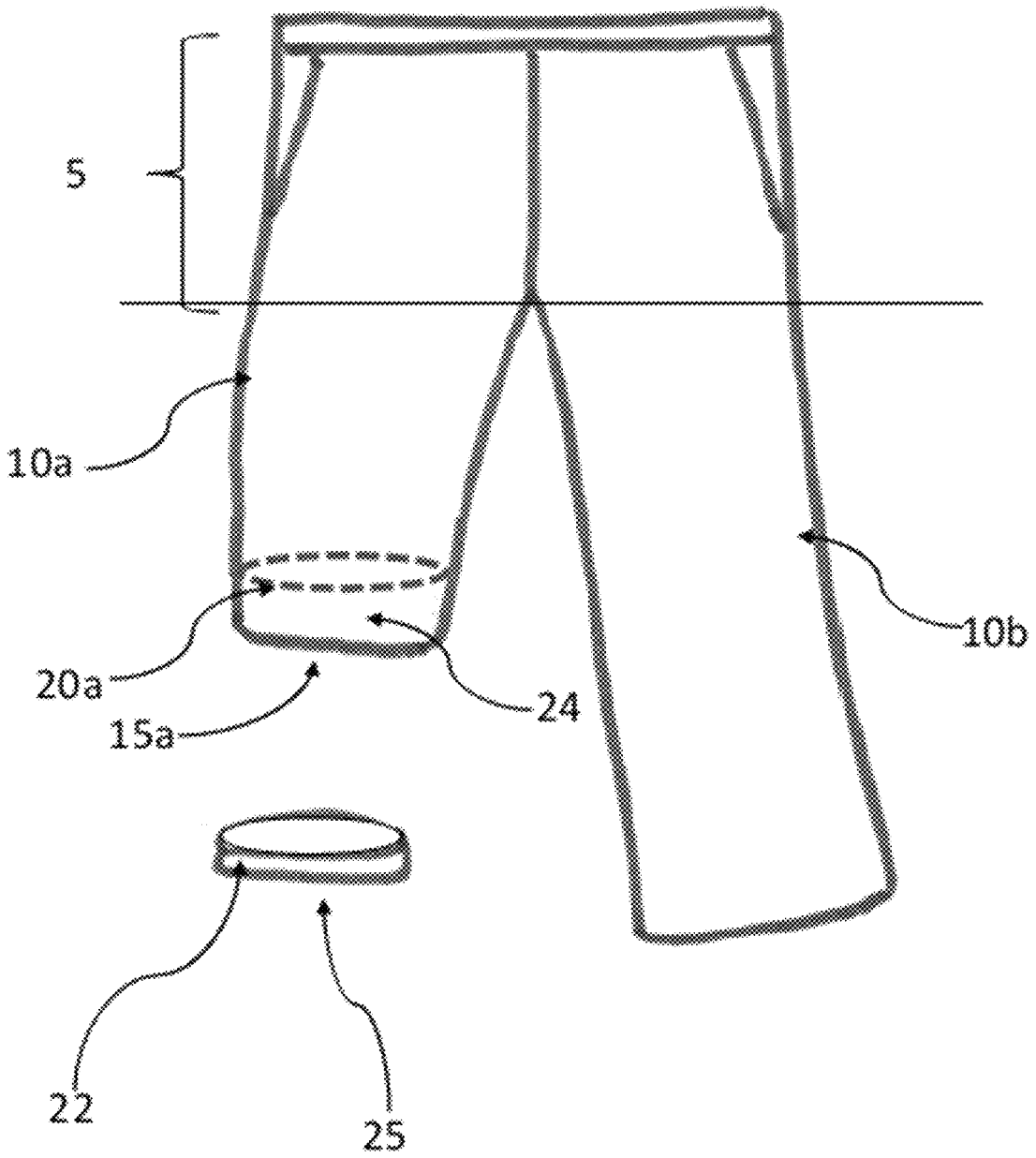
FIG. 1C is an exemplary illustration of the contemplated pant clothing having pant legs of different lengths with the shorter length pant leg 10*a* having a modified distal opening 15*a* that is capable of being coupled at attachment point or means 20*a* to a cover portion 25, where the attachment point 20*a* may be inside the pant leg 10*a* up a distance from the pant leg opening forming a pant cuff section 24, according to embodiments of the present disclosure.
Figure 1D:
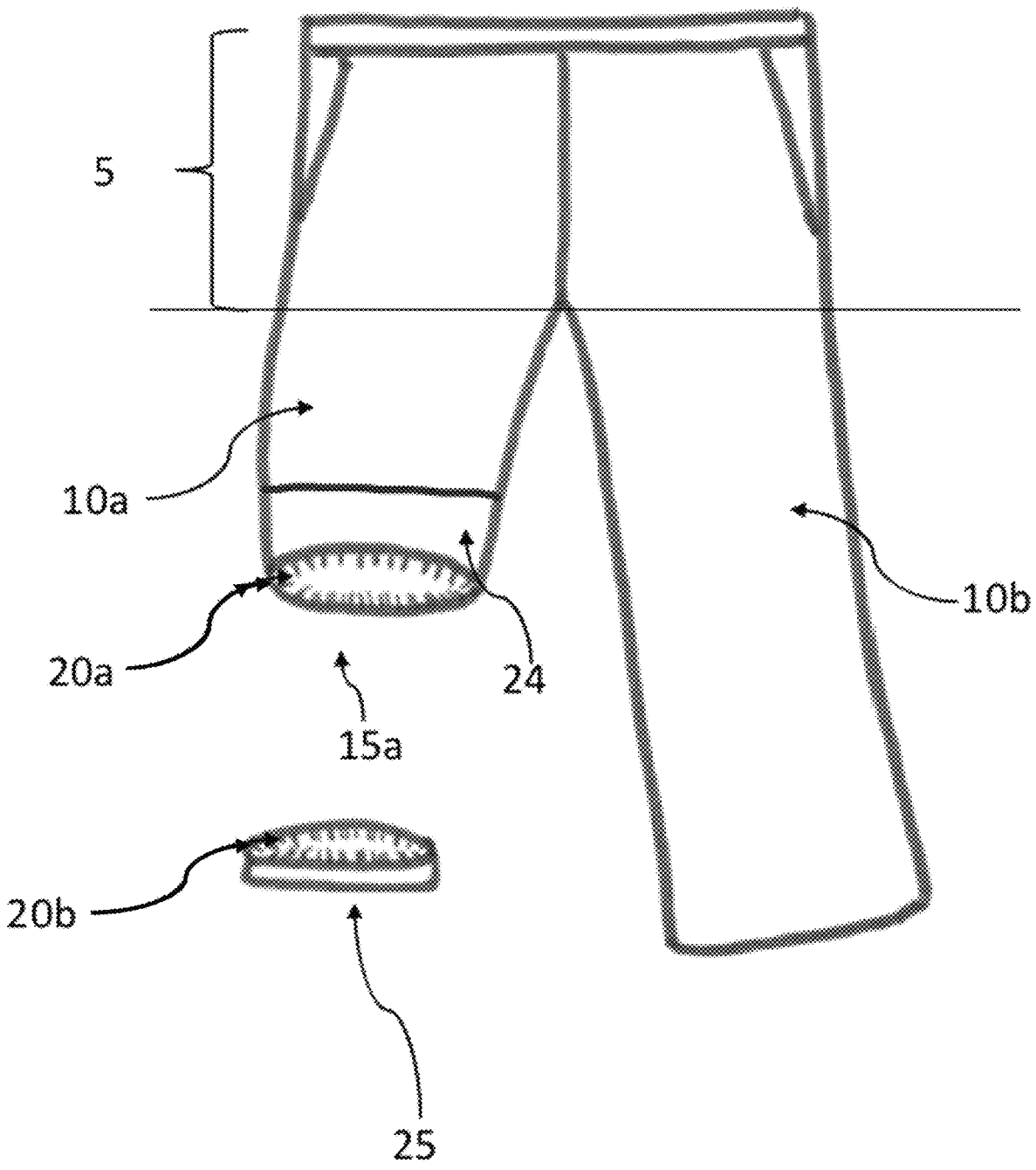
FIG. 1D is an exemplary illustration of the contemplated pant clothing having pant legs of different lengths with the shorter length pant leg 10*a* having a modified distal opening 15*a* that is capable of being coupled at attachment point or means 20*a* to a cover portion 25 having attachment means 20*b*, where the attachment point 20*a* may be inside the pant leg 10*a* up a distance from the pant leg opening forming a pant cuff section 24 which is depicted as being folded up in this illustration to expose and provide access to the attachment means 20*a*, according to embodiments of the present disclosure.

With reference to FIGS. 1C-1D, the cover portion 25 can be inserted into the pant leg 10*a* and attached, e.g., by folding the cover portion 25 into the pant leg 10*a* or by using one or more attachment means 20*a*, 20*b*. In some embodiments, the location of attachment of the cover portion 25 in the pant leg 10*a* may be at the distal opening 15*a* as shown in FIG. 1B. Typically, as shown in FIG. 1C, the cover portion 25 attaches at 20*a* in the pant leg 10*a* where 20*a* is up the pant leg away from the distal opening 15*a*, thereby providing a pant cuff section 24. In FIG. 1D, the pant cuff section 24 is shown folded up the pant leg. With the pant cuff section 24 folded up the pant leg, the means of attachment 20*a* on the pant leg 10*a* is more readily accessible for attachment to the means of attachment 20*b* on the cover portion 25. The means of attachment 20*a* correspond as a cognate pair to the means of attachment 20*b* on the cover portion 25 to enable attachment of the cover portion 25 to cover the distal opening 15, thereby prohibiting exposure of the residual limb.

Figure 1E:
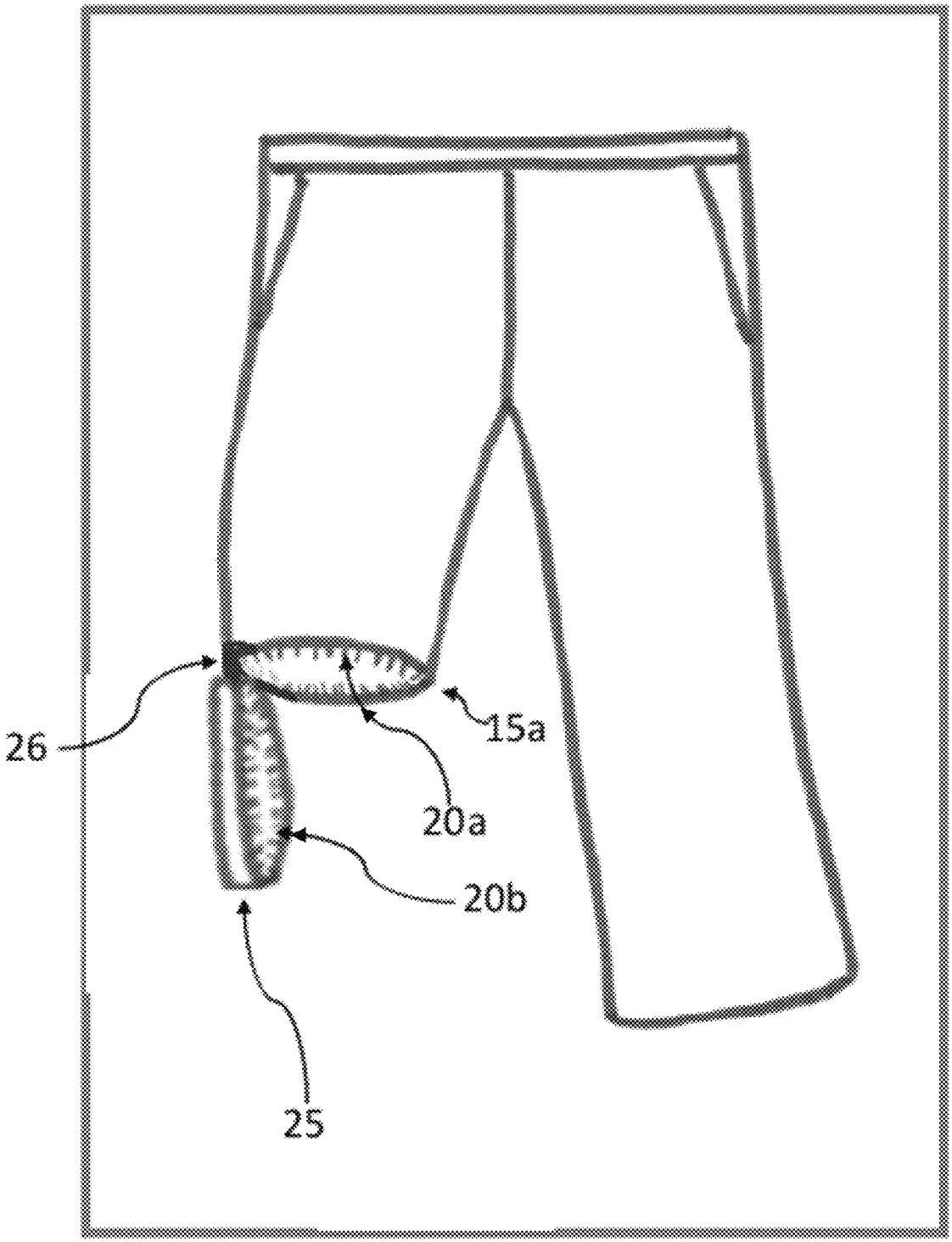
FIG. 1E is an exemplary illustration of the contemplated pant clothing having pant legs of different lengths with the shorter length pant leg 10*a* having a modified distal opening 15*a* that is attached to a cover portion 25 by attachment 26, where the cover portion can fully attach to the modified distal opening 15*a* by its attachment means 20*b* attaching with the attachment means 20*a*, according to embodiments of the present disclosure.

With reference to FIG. 1E, in one embodiment, an edge of the cover portion 25 may be attached to the pant leg 10*a* by one or more attachment 26. The attachment 26 may any suitable means of attachment. For example, the cover portion 25 may be sewn to the pant leg 10*a* at the attached location 26 of the modified distal opening 15*a*. Additionally, the cover portion 25 may be attached using any of the attachment means disclosed herein for the means of attachment 20*a*, but the attachment 26 would be separate and independent from the attachment means 20*a*. As would be understood by the skilled person, the form or means of attachment 26 which could be any of the means for attachment 20*a*, can be different from the means of attachment 20*a*. For example, the cover portion 25 could be sewn at attachment 26 could be attached by zipper, cinch tie or cinch cord, buttons and buttonholes, snaps, and/or hook and loop fastener (e.g., Velcro®). A combination of these attachments is also possible.

The contemplated pants and cover portion may be made from any desired fabric. In some embodiments, the pants and the cover portion are made from the same fabric. Typically, the outer fabric of the pants and the outer fabric of the cover portion 25 is the same. It may be cotton (including organic and recycled cotton), denim, hemp, lyocell (regenerated cellulose fiber fabric, e.g., Tencel™) polyester, elastane, polyether-polyurea copolymer blends (e.g., Lycra®), nylon, linen, satin, rayon, or any combination or blends thereof. Additionally, the outer fabric of the pants and the outer fabric of the cover portion 25 may be the same with the cover portion having an inner fabric lining. The inner fabric lining may be throughout the pant clothing item including the cover portion 25. Typically, the cover portion 25 has an outer fabric and an inner fabric lining. The outer fabric material may be selected based on design and/or aesthetic preference. The inner fabric lining may be made of any suitable or desired material. Preferably, the inner fabric lining of the cover portion is a skin-sensitive fabric. For example, the inner fabric of the cover portion 25 may made of any non-irritating mesh material. Preferably, the mesh material is made of a soft mesh material. For example, the mesh material may be made of cotton, lyocell, and/or nylon. A soft non-irritating material provides comfort to the residual limb which may be sensitive to materials having a rough or scratchy feel.

Notably, with reference to FIGS. 1D and 1E, the first means of attachment 20*a* on the modified distal opening 15*a* corresponds to the second means of attachment 20*b* on the cover portion 25. Non-limiting examples of corresponding means of attachment include a zipper, cinch tie or cinch cord, buttons and buttonholes, snaps, and/or hook and loop fastener (e.g., Velcro®). Additionally, more than one type of attachment means may be used. For example, the modified distal opening 15*a* may attach to the cover portion 25 by a series of snaps on an inner section of fabric on the distal opening of the leg and inner section of the cover portion with zipper attachments surrounding the snaps to fully encase the snaps. In another embodiment, a cinch cord may be threaded to the end of the modified distal opening 15*a* to close off the opening upon cinching. In this embodiment, the cover portion 25 may not be needed to close off the modified distal opening. Alternatively, a cinch cord may be threaded through the modified distal opening 15*a* and the modified distal opening 15*a* and the cover portion 25 may have a zipper system which zips the cover portion 25 over the modified distal opening 15*a* with the cinch cord to cover up the closed/cinched opening and give the modified distal opening a more custom look.

In other embodiments, an area of the cover portion 25 is attached to an area of the distal opening that is separate from the means of attachment (20*a*, 20*b*) that enclose the distal opening of the pant leg. For example, a small section of the cover portion 25 may be attached irreversibly or reversibly to a small section of the distal opening of the pant leg 10*a*, thereby allowing for the cover portion to remain attached to the pant leg when the first means and the second means of attachment are unattached. This contemplated configuration allows for access to the residual limb without complete removal of the cover portion 25. For example, the area of the cover portion may be sewn to the pant leg. In another example, the area of the cover portion may have a second set of corresponding means of attachment (e.g., zipper, cinch tie or cinch cord, buttons and buttonholes, snaps, and/or hook and loop fastener (e.g., Velcro®)), which are distinct from the means that are capable of enclosing the entire distal opening of the pant leg.

Figure 2:
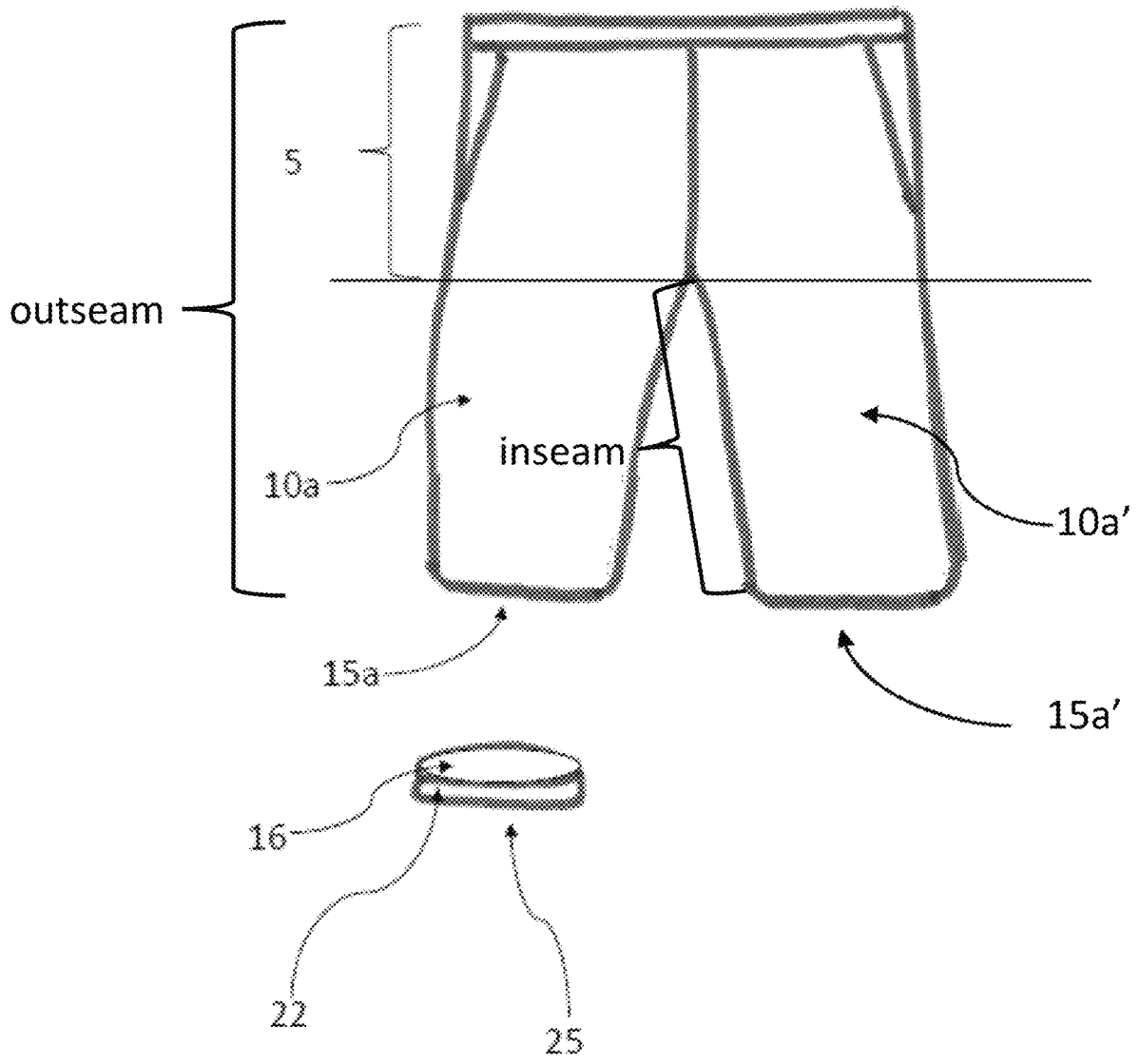
FIG. 2 is an exemplary illustration of the contemplated pant clothing having two pant legs 10*a* and 10*a*' each having a modified distal opening 15*a* and 15*a*', as shown, with any cover portion 25 as disclosed herein, for covering each of the distal openings 15*a*, 15*a*' with any means of attachment as disclosed herein and shown in FIGS. 1A-1E, according to embodiments of the present disclosure.

With reference to FIG. 2, a pant clothing item for a double amputee includes two pant legs 10*a* and 10*a*', each having a modified distal opening 15*a* and 15*a*'. The cover portion 25 may be the same or different for each pant leg 10*a*, 10*a*', depending on the need or care required for the respective residual limbs. A pant clothing item for a double amputee may include two cover portions 25 and may include a means of attachment 26 as disclosed herein on each pant leg 10*a*, 10*a*'. Accordingly, the features disclosed in FIGS. 1A-1E for pant leg 10*a*, may be incorporated in pant leg 10*a*'. Furthermore, the features for pant leg 10*a* may be the same or different from those selected for pant leg 10*a*'. As mentioned, the selected features may be different to more easily accommodate the medical needs or configuration of each residual limb.

The pant clothing item having at least one modified distal opening 15*a* may be shorts, a culotte, or pants. The length of the inseams and outseams on the pants clothing item having at least one modified distal opening 15*a*, may be of any length that is suitable for fitting the uniped or bilateral (or double) amputee person. Of course, the person wearing the pant clothing item may be a child or an adult. Furthermore, persons who are adults do not necessarily wear what are considered "adult sizes" as they could wear smaller sizes. Likewise, a child may not necessarily wear a "child's size" as an adult size may fit the child more appropriately.

In some aspects, a pair of shorts with one modified distal opening 15*a* would have a distal opening 15*b* wherein the pant leg 10*b* has a length that does cover the entire leg of the person's full leg. For an example, the inseam of the pant legs 10*a*, 10*b* on a pair of shorts may be in the range of between 3 inches to 10 inches and the outseam of the short pants leg 10*a*, 10*b* of a pair of shorts may be in the range of between about 5 inches to 25 inches.

Similarly, for a pair of pants with a modified distal opening 15*a* on the pant leg 10*a*, the inseam of the pant leg 10*a* may range of between 3 inches to 40 inches, and typically the pant leg 10*a* with a modified distal opening 15*a* has an inseam of between 3 inches to 30 inches or 3 inches to 20 inches. The outseam of the pant leg 10*a* with a modified distal opening 15*a* is of between 6 inches to 50 inches, and typically the outseam of the pant leg 10*a* with a modified distal opening 15*a* is of between 6 inches to 40 inches. The outseam of the pant leg 10*b* without the modified distal opening may have any suitable length to fit the person's full leg and trunk portion up to the person's hip or waist. For example, the inseam of the pant leg 10*b* is of between 15 inches to 40 inches, and the outseam of the pant leg 10*b* is the sum of the inseam length (e.g. 15 to 40 inches) and the length of the upper portion 5—from the top of the leg to the hip or waist.

In some exemplary embodiments, the inseam of the pant leg 10*a* with a modified distal opening 15*a* can have a length of 3, 4, 5, 6, 7, 8, 9 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40 inches. More typically, the inseam of the pant leg 10*a* is of between about 3 to 30 inches, 3 to 25 inches, 3 to 20 inches, 3 to 15 inches, or 3 to 10 inches and the pant leg 10*b* is of between about 3 to 40 inches.

In some embodiments, the pant clothing item for a uniped may have a pant leg 10*a* with a modified distal opening 15*a* in which the inseam length is the same as the inseam length of the pant leg 10*b* which does not have a modified distal opening. Typically, the pant clothing item for a uniped includes a pant leg 10*a* that has an inseam length that is less than the inseam length of pant leg 10*b*.

In still other embodiments, the pant clothing item for a double amputee as shown in FIG. 2, has two pant legs of 10*a*, where the length of the inseam of the first pant leg 10*a* and the second pant leg 10*a*' may be as disclosed herein and may be the same length or may be different. The difference in lengths of the first pant leg 10*a* and the second pant leg 10*a*' may depend on the length of each of the two residual limbs.

As used herein, and unless the context dictates otherwise, the term "coupled to" is intended to include both direct coupling (in which two elements, two portions, or two sections) are coupled to each other and contact each other) and indirect coupling (in which at least one additional element is located between the two elements, two portions, or two sections). Therefore, the terms "coupled to" and "coupled with" are used synonymously. For example, two portions/sections of the pant clothing may be coupled "continuously," in which case material is cut and/or sewn to create the two coupled portions (e.g., a trunk portion and proximal pant leg openings from a piece of material or fabric such that a means of attachment is not required for the trunk portion and pant legs to be coupled together. In some aspects, coupling includes at least one means of attachment for coupling the two elements, two portions, or two sections together.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A pant clothing item comprising:

an upper trunk portion and two pant legs formed distally from the upper trunk portion, the two pant legs including a first pant leg and a second pant leg, the two pant legs of same or different lengths, wherein each of the two pant legs has a distal opening;

at least one of the two distal openings being a modified distal opening, wherein the modified distal opening comprises a first attachment;

at least one flat cover portion comprising a second attachment, the at least one flat cover portion capable of being partially detached from at least one of the two pant legs, and the at least one flat cover portion comprising an edge partially sewn to the at least one of the two pant legs, wherein the second attachment corresponds with the first attachment on the modified distal opening, wherein when the first attachment and the second attachment are completely attached, the at least one flat cover portion is attached to the modified distal opening and the modified distal opening is closed, and wherein the first attachment:

i) is positioned around the modified distal opening; or ii) is positioned inside and around the at least one of the two pant legs up a distance from the modified distal opening.

2. The pant clothing item of claim 1, wherein the first attachment and the second attachment are selected from a zipper system, buttons and buttonholes, snaps, a hook and loop fastener, or a combination thereof.

3. The pant clothing item of claim 1, wherein the two pant legs are of different lengths.

4. The pant clothing item of claim 1, wherein the first pant leg has a length shorter than the second pant leg.

5. The pant clothing item of claim 1, wherein each of the two pant legs have a modified distal opening, and wherein the pant clothing item comprises two flat cover portions, one for each of the two modified distal openings.

6. The pant clothing item of claim 1, wherein the pant clothing item including the trunk portion, the two pant legs, and the at least one flat cover portion are made of at least one type of fabric, and wherein the at least one flat cover portion further comprises an inside fabric lining.

7. The pant clothing item of claim 6, wherein the fabric is selected from cotton, denim, hemp, lyocell, polyester, elastane, polyether-polyurea copolymer blends, nylon, linen, satin, rayon, or any combination thereof.

8. The pant clothing item of claim 6, wherein the at least one flat cover portion comprises a mesh material.

9. The pant clothing item of claim 1, wherein the first pant leg and the second pant leg each have an inseam length that is independently selected from 3 inches to 40 inches.

10. The pant clothing item of claim 1, wherein the pant clothing item is selected from pants, shorts, or a culotte.

11. The pant clothing item of claim 9, wherein the first pant leg has an inseam length in a range from 3 to 20 inches.

12. The pant clothing item of claim 11, wherein the first pant leg has an inseam length of 18 inches.

13. The pant clothing item of claim 11, wherein the first pant leg has an inseam length of 19 inches.

14. The pant clothing item of claim 11, wherein the first pant leg has an inseam length of 20 inches.

15. The pant clothing item of claim 9, wherein the first pant leg has an inseam length in a range from 3 to 10 inches.

16. The pant clothing item of claim 5, wherein the first pant leg and the second pant leg each independently have an inseam length in a range from 3 to 20 inches.

17. The pant clothing item of claim 5, wherein the first pant leg and the second pant leg each independently have an inseam length in a range from 3 to 10 inches.

* * * * *